US007858180B2

(12) United States Patent
Bhatnagar et al.

(10) Patent No.: US 7,858,180 B2
(45) Date of Patent: Dec. 28, 2010

(54) HIGH TENACITY POLYOLEFIN ROPES HAVING IMPROVED STRENGTH

(75) Inventors: Ashok Bhatnagar, Richmond, VA (US); Lori L. Wagner, Richmond, VA (US); Gregory A. Davis, Mechanicsville, VA (US); Barbara M. Costain, Richmond, VA (US); Henry G. Ardiff, Chesterfield, VA (US)

(73) Assignee: Honeywell International Inc., Morristown, NJ (US)

( * ) Notice: Subject to any disclaimer, the term of this patent is extended or adjusted under 35 U.S.C. 154(b) by 210 days.

(21) Appl. No.: 12/150,400

(22) Filed: Apr. 28, 2008

(65) Prior Publication Data

US 2009/0269583 A1 Oct. 29, 2009

(51) Int. Cl.
*D02G 3/00* (2006.01)

(52) U.S. Cl. ..... 428/357; 428/364; 57/241

(58) Field of Classification Search ..... 428/357, 428/370, 364, 377, 198, 298.1; 57/241
See application file for complete search history.

(56) References Cited

U.S. PATENT DOCUMENTS

| | | | | |
|---|---|---|---|---|
| 4,137,394 | A | 1/1979 | Meihuizen et al. | 528/100 |
| 4,356,138 | A | 10/1982 | Kavesh et al. | 264/164 |
| 4,413,110 | A | 11/1983 | Kavesh et al. | 526/348.1 |
| 4,430,383 | A | 2/1984 | Smith et al. | 428/364 |
| 4,436,689 | A | 3/1984 | Smith et al. | 264/204 |
| 4,457,985 | A | 7/1984 | Harpell et al. | 428/224 |
| 4,536,536 | A | 8/1985 | Kavesh et al. | 524/462 |
| 4,545,950 | A | 10/1985 | Motooka et al. | 264/210.6 |
| 4,551,296 | A | 11/1985 | Kavesh et al. | 264/203 |
| 4,612,148 | A | 9/1986 | Motooka et al. | 264/49 |
| 4,617,233 | A | 10/1986 | Ohta et al. | 428/364 |
| 4,663,101 | A | 5/1987 | Kavesh et al. | 264/178 F |
| 5,032,338 | A | 7/1991 | Weedon et al. | 264/203 |
| 5,061,545 | A | 10/1991 | Li et al. | 428/195 |
| 5,180,636 | A * | 1/1993 | Harazoe et al. | 428/373 |
| 5,246,657 | A | 9/1993 | Yagi et al. | 264/210.6 |
| 5,286,435 | A | 2/1994 | Slutsker et al. | 264/205 |
| 5,342,567 | A | 8/1994 | Chen et al. | 264/203 |
| 5,578,374 | A | 11/1996 | Dunbar et al. | 428/364 |
| 5,702,657 | A | 12/1997 | Yoshida et al. | 264/112 |
| 5,736,244 | A | 4/1998 | Kavesh et al. | 428/364 |
| 5,741,451 | A | 4/1998 | Dunbar et al. | 264/103 |
| 5,901,632 | A | 5/1999 | Ryan | 87/13 |
| 5,910,361 | A * | 6/1999 | Guevel et al. | 428/364 |
| 5,931,076 | A | 8/1999 | Ryan | 87/8 |
| 5,958,582 | A | 9/1999 | Dunbar et al. | 428/364 |
| 5,972,498 | A | 10/1999 | Kavesh et al. | 428/364 |
| 6,448,359 | B1 | 9/2002 | Kavesh | 526/352 |

(Continued)

FOREIGN PATENT DOCUMENTS

| | | |
|---|---|---|
| WO | WO2007/062803 | 6/2007 |

*Primary Examiner*—N. Edwards
(74) *Attorney, Agent, or Firm*—Erika S. Wilson

(57) ABSTRACT

A rope comprising a plurality of high tenacity polyolefin yarns aligned in a substantially uniaxial direction along the length of the rope. The rope yarns are substantially untwisted and are substantially parallel to each other. The yarns are formed from a plurality of fibers aligned in a substantially uniaxial direction along the length of the yarns, with the fibers being substantially untwisted and being substantially parallel to each other. The fibers comprise high tenacity polyolefin fibers. Adjacent yarns are connected together by contact of their respective resin surface coatings.

21 Claims, 3 Drawing Sheets

U.S. PATENT DOCUMENTS

| | | | | |
|---|---|---|---|---|
| 6,682,816 | B1 * | 1/2004 | Wang | 428/373 |
| 6,846,548 | B2 | 1/2005 | Harpell et al. | 428/198 |
| 6,945,153 | B2 | 9/2005 | Knudsen et al. | 87/1 |
| 6,969,553 | B1 | 11/2005 | Tam et al. | 428/364 |
| 7,211,291 | B2 | 5/2007 | Harpell et | 427/180 |
| 7,296,394 | B2 | 11/2007 | Clough et al. | 57/210 |
| 2005/0093200 | A1 | 5/2005 | Tam et al. | 264/211.14 |
| 2005/0274101 | A1 | 12/2005 | Wang | 57/241 |
| 2007/0202328 | A1 | 8/2007 | Davis et al. | 428/375 |
| 2007/0202329 | A1 | 8/2007 | Davis et al. | 428/375 |

* cited by examiner

HIGH TENACITY POLYOLEFIN ROPES HAVING IMPROVED STRENGTH

BACKGROUND OF THE INVENTION

1. Field of the Invention

This invention relates to improvements in ropes, and in particular to high tenacity synthetic ropes suitable for use in various applications.

2. Description of the Related Art

Synthetic fiber ropes have been used in a variety of applications, including marine and other applications. One type of rope that has excellent properties is rope made from high modulus polyolefin fibers and/or yarns. High tenacity polyolefin fibers are also known as extended chain or high molecular weight fibers. These fibers and yarns are available, for example, as SPECTRA® extended chain polyethylene fibers and yarns from Honeywell International Inc. and other suppliers.

Ropes formed from high tenacity fibers are typically made in the usual manner in which ropes are formed. In a typical construction, the ropes are formed from fibers that are twisted together to form yarns, and the yarns are braided together to either form the rope or form strands that are braided together to form a braided rope. Examples of such ropes which have been suggested for use in marine applications are U.S. Pat. Nos. 5,901,632 and 5,931,076 both to Ryan, and U.S. Pat. No. 6,945,153 to Knudsen et al., the disclosures of which are expressly incorporated herein by reference to the extent not incompatible herewith.

It has been proposed to improve the cyclic bend resistance of such ropes by coating the fibers or ropes with a composition of an amino functional silicone resin and a neutralized low molecular weight polyethylene. Such ropes are disclosed in U.S. published patent application 2007-0202328 A1 to Davis et al. and in U.S. published patent application 2007-0202329 A1 to Davis et al.; the latter structure also includes fluoropolymer fibers blended with the polyethylene fibers. The disclosures of these publications are expressly incorporated herein by reference to the extent not incompatible herewith.

Although ropes formed from high tenacity polyolefin fibers exhibit excellent properties which make them attractive for various end uses including marine applications, it would be desirable to provide ropes that had increased strength such that the ropes can be used for many demanding applications.

SUMMARY OF THE INVENTION

In accordance with this invention, there is provided a rope comprising a plurality of yarns aligned in a substantially uniaxial direction along the length of the rope, the yarns being substantially untwisted and being substantially parallel to each other, the yarns comprising a plurality of fibers aligned in a substantially uniaxial direction along the length of the yarns, the fibers being substantially untwisted and being substantially parallel to each other, the fibers comprising high tenacity polyolefin fibers, and a resin coated on the surface of the yarns, wherein adjacent yarns are connected together by contact of their respective resin coatings, and wherein the resin comprises a flexible thermoplastic material.

Also in accordance with this invention, there is provided a rope consisting essentially of a plurality of yarns aligned in a substantially uniaxial direction along the length of the rope, the yarns being substantially untwisted and being substantially parallel to each other, the yarns consisting essentially of a plurality of fibers aligned in a substantially uniaxial direction along the length of the yarns, the fibers being substantially untwisted and being substantially parallel to each other, the fibers consisting essentially of high tenacity polyethylene fibers, and a resin coated on the surface of the yarns, wherein adjacent yarns are connected together by contact of their respective resin coatings, and wherein the resin comprises a flexible thermoplastic material.

Further in accordance with this invention, there is provided a method of forming a rope, the method comprising:

(a) providing a plurality of yarns, the yarns comprising a plurality of fibers aligned in a substantially uniaxial direction along the length of the yarns, the fibers being substantially untwisted and being substantially parallel to each other, the fibers comprising high tenacity polyolefin fibers;

(b) aligning a plurality of the yarns in a substantially uniaxial direction, with the yarns being substantially parallel to each other;

(c) applying a resin coating to the surface of the yarns, the resin comprising a flexible thermoplastic material;

(d) drying the coated yarns;

(e) passing the dried yarns into a shaping die;

(f) shaping the plurality of coated yarns in the shaping die into a rope of a desired shape, wherein adjacent yarns are connected together by contact of their respective resin coatings, with the plurality of yarns extending in a substantially uniaxial direction along the length of the rope, the yarns being substantially untwisted and substantially parallel to each other; and (g) collecting the rope.

Still further in accordance with this invention, there is provided a method of improving the breaking strength of a rope comprising high tenacity polyolefin fibers, the method comprising forming the rope from a plurality of yarns that are aligned in a substantially uniaxial direction along the length of said rope, the yarns being substantially untwisted and being substantially parallel to each other, the yarns comprising a plurality of fibers aligned in a substantially uniaxial direction along the length of the yarns, the fibers being substantially untwisted and being substantially parallel to each other, the fibers comprising high tenacity polyolefin fibers, and a resin coated on the surface of the yarns, wherein adjacent yarns are connected together by contact of their respective resin coatings, and wherein the resin comprises a flexible thermoplastic material.

It has been discovered that ropes of substantially improved strength can be formed from high tenacity polyolefin fibers that are substantially uniaxially oriented and substantially parallel to each other, which fibers are formed into yarns that are substantially uniaxially oriented and substantially parallel to each other, with a resin coating holding adjacent fibers together.

DETAILED DESCRIPTION OF THE INVENTION

Figure 1:
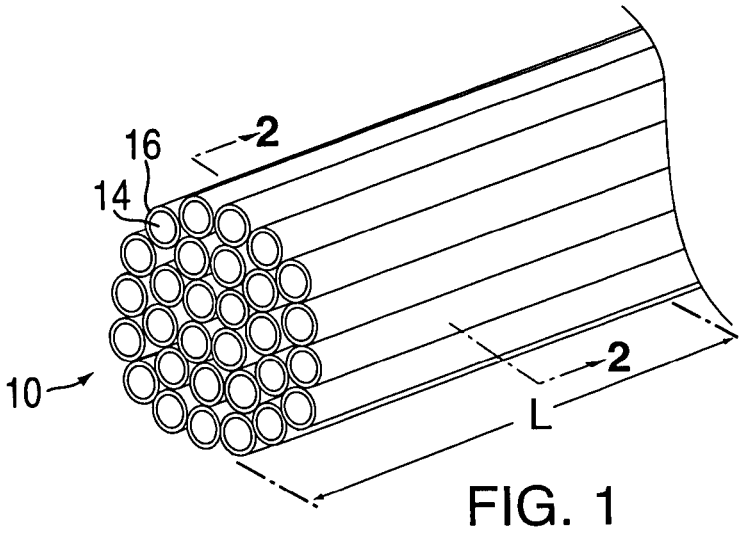
FIG. 1 is a schematic view of a rope of the invention.

The fibers used in the rope construction of this invention are high tenacity fibers. As used herein, the term "high tenacity fibers" means fibers which have tenacities equal to or greater than about 7 g/d. Preferably, these fibers have initial tensile moduli of at least about 150 g/d and energies-to-break of at least about 8 J/g as measured by ASTM D2256. As used herein, the terms "initial tensile modulus", "tensile modulus" and "modulus" mean the modulus of elasticity as measured by ASTM 2256 for a yarn.

For the purposes of the present invention, a fiber is an elongate body the length dimension of which is much greater that the transverse dimensions of width and thickness. Accordingly, the term fiber includes monofilament, multifilament, ribbon, strip, staple and other forms of chopped, cut or discontinuous fiber and the like having regular or irregular cross-section. The term "fiber" includes a plurality of any of the foregoing or a combination thereof. A yarn is a continuous strand comprised of many fibers or filaments.

Preferably, the high tenacity fibers have tenacities equal to or greater than about 10 g/d, more preferably equal to or greater than about 15 g/d, even more preferably equal to or greater than about 20 g/d, and most preferably equal to or greater than about 25 g/d.

The fibers utilized in the rope construction of this invention comprise extended chain (also known as high molecular weight or high modulus) polyolefin fibers, particularly high tenacity polyethylene fibers and polypropylene fibers, and blends thereof.

The cross-sections of fibers useful herein may vary widely. They may be circular, flat or oblong in cross-section. They may also be of irregular or regular multi-lobal cross-section having one or more regular or irregular lobes projecting from the linear or longitudinal axis of the fibers. It is preferred that the fibers be of substantially circular, flat or oblong cross-section, most preferably substantially circular cross-section.

U.S. Pat. No. 4,457,985 generally discusses such high molecular weight polyethylene and polypropylene fibers, and the disclosure of this patent is hereby incorporated by reference to the extent that it is not inconsistent herewith. In the case of polyethylene, suitable fibers are those of weight average molecular weight of at least about 150,000, preferably at least about one million and more preferably between about two million and about five million. Such high molecular weight polyethylene fibers may be spun in solution (see U.S. Pat. Nos. 4,137,394 and 4,356,138), or a filament spun from a solution to form a gel structure (see U.S. Pat. No. 4,413,110, German Off. No. 3,004,699 and GB Patent No. 2051667), or the polyethylene fibers may be produced by a rolling and drawing process (see U.S. Pat. No. 5,702,657). As used herein, the term polyethylene means a predominantly linear polyethylene material that may contain minor amounts of chain branching or comonomers not exceeding about 5 modifying units per 100 main chain carbon atoms, and that may also contain admixed therewith not more than about 50 wt % of one or more polymeric additives such as alkene-l-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as antioxidants, lubricants, ultraviolet screening agents, colorants and the like which are commonly incorporated.

High tenacity polyethylene fibers are preferred, and these are available, for example, under the trademark SPECTRA® fibers and yarns from Honeywell International Inc. of Morristown, N.J., U.S.A.

Depending upon the formation technique, the draw ratio and temperatures, and other conditions, a variety of properties can be imparted to these fibers. The tenacity of the polyethylene fibers are at least about 7 g/d, preferably at least about 15 g/d, more preferably at least about 20 g/d, still more preferably at least about 25 g/d and most preferably at least about 30 g/d. Similarly, the initial tensile modulus of the fibers, as measured by an Instron tensile testing machine, is preferably at least about 300 g/d, more preferably at least about 500 g/d, still more preferably at least about 1,000 g/d and most preferably at least about 1,200 g/d. These highest values for initial tensile modulus and tenacity are generally obtainable only by employing solution grown or gel spinning processes. Many of the filaments have melting points higher than the melting point of the polymer from which they were formed. Thus, for example, high molecular weight polyethylene of about 150,000, about one million and about two million molecular weight generally have melting points in the bulk of 138° C. The highly oriented polyethylene filaments made of these materials have melting points of from about 7° C. to about 13° C. higher. Thus, a slight increase in melting point reflects the crystalline perfection and higher crystalline orientation of the filaments as compared to the bulk polymer.

Preferably the polyethylene employed is a polyethylene having fewer than about one methyl group per thousand carbon atoms, more preferably fewer than about 0.5 methyl groups per thousand carbon atoms, and less than about 1 wt. % of other constituents.

Similarly, highly oriented high molecular weight polypropylene fibers of weight average molecular weight at least about 200,000, preferably at least about one million and more preferably at least about two million may be used. Such extended chain polypropylene may be formed into reasonably well oriented filaments by the techniques prescribed in the various references referred to above, and especially by the technique of U.S. Pat. No. 4,413,110. Since polypropylene is a much less crystalline material than polyethylene and contains pendant methyl groups, tenacity values achievable with polypropylene are generally substantially lower than the corresponding values for polyethylene. Accordingly, a suitable tenacity is preferably at least about 8 g/d, more preferably at least about 11 g/d. The initial tensile modulus for polypropylene is preferably at least about 160 g/d, more preferably at least about 200 g/d. The melting point of the polypropylene is generally raised several degrees by the orientation process, such that the polypropylene filament preferably has a main melting point of at least 168° C., more preferably at least 170° C. The particularly preferred ranges for the above described parameters can advantageously provide improved performance in the final article. Employing fibers having a weight average molecular weight of at least about 200,000 coupled with the preferred ranges for the above-described parameters (modulus and tenacity) can provide advantageously improved performance in the final article.

In the case of extended chain polyethylene fibers, preparation and drawing of gel-spun polyethylene fibers are described in various publications, including U.S. Pat. Nos. 4,413,110; 4,430,383; 4,436,689; 4,536,536; 4,545,950; 4,551,296; 4,612,148; 4,617,233; 4,663,101; 5,032,338;

5,246,657; 5,286,435; 5,342,567; 5,578,374; 5,736,244; 5,741,451; 5,958,582; 5,972,498; 6,448,359; 6,969,553 and U.S. patent application publication 2005/0093200, the disclosures of which are expressly incorporated herein by reference to the extent not incompatible herewith.

The ropes of this invention comprise the high tenacity polyolefin fibers, or consist essentially of the high tenacity polyolefin fibers, or consist of the high tenacity polyolefin fibers, and the polyolefin fibers preferably are high tenacity polyethylene fibers. As used herein, the term "rope" means a fibrous structure that has a length being substantially greater than its thickness and has a relatively thick cross-section. The ropes of the invention are distinct from uniaxial tapes ("unitapes") of fibers or yarns, which are relatively very thin structures (having a thickness of about 0.0027 inch (0.069 mm)). The term "rope" includes structures also known as slings. The ropes of this invention are characterized as being formed from yarns that are aligned in a substantially uniaxial direction along the length of the rope. By "substantially uniaxial direction" is meant that all or almost all (for example, at least about 95%, more preferably at least about 99%) of the yarns extend in a single direction. The yarns are substantially untwisted and are substantially parallel to each other. By "substantially untwisted" means that the yarns have zero twist or very little twist along their length (for example, no more than about 5 turns per inch, preferably no more than about 1 turn per inch along the length of the yarn). By "substantially parallel" means that all or almost all (for example, at least about 90%, more preferably at least about 95%) of the yarns are parallel to each other.

The yarns that form the rope of this invention comprise a plurality of fibers that are aligned in a substantially uniaxial direction along the length of the yarn. The fibers are substantially untwisted and are substantially parallel to each other. As used herein, the terms "substantially uniaxial direction", "substantially untwisted" and "substantially parallel" have similar meanings to those set forth in the preceding paragraph.

The yarns of the high tenacity fibers used herein may be of any suitable denier, such as, for example, about 50 to about 5000 denier, more preferably from about 100 to about 4800 denier, still more preferably from about 650 to about 4800 denier, and most preferably from about 800 to about 4800 denier.

The number of fibers forming the yarns used in this invention may vary widely depending on the desired size of the rope and the intended applications. For example, the number of fibers in a yarn may range from about 10 to about 3000, more preferably from about 30 to about 1500, and most preferably from about 60 to about 1300. Although not required, the number of fibers in each yarn preferably is substantially the same.

Likewise, the number of yarns forming the rope of this invention may vary widely. For example, the number of yarns may range from about 2 to about 50,000, more preferably from about 30 to about 20,000, and most preferably from about 50 to about 10,000.

The ropes may be of any suitable diameter. For example, the ropes may have a diameter of at least about 0.0625 inch (1.59 mm), such as from about 0.0625 inch (1.59 mm) to about 10 inches (254 mm), more preferably from about 1 inch (25.4 mm) to about 6 inches (152 mm), and most preferably from about 1.5 inches (38.1 mm) to about 5 inches (127 mm). The ropes may be formed in any suitable manner from the desired fibers and/or yarns provided that the yarns are arranged as specified herein.

The yarns used in the rope construction of this invention are held together by means of a resin that is coated on the surface of the yarns. The coating may be continuous or discontinuous over the length of the yarns. In the final rope construction, the resin coating serves to adhere the yarns in place such that adjacent yarns are connected together by contact of their respective resin coatings. By coating the yarns, the individual fibers may be at least partially coated with the resin. If desired, the fibers may be pre-coated with the resin and then formed into a yarn, which in turn is formed into a rope, or the yarn formed from the coated fibers may in turn be coated with the resin. The coating on the fibers may act as a tie-layer between the fibers and the coating that is applied to the yarn. In one embodiment, the fibers forming the yarns of the rope are not coated with a matrix or similar resin.

The resin of the yarn coating comprises a flexible thermoplastic material. The resin may be formed from a wide variety of elastomeric and other materials having desired characteristics. In one embodiment, elastomeric materials useful herein possess initial tensile modulus (modulus of elasticity) equal to or less than about 6,000 psi (41.4 MPa) as measured by ASTM D638. More preferably, the elastomer has initial tensile modulus equal to or less than about 2,400 psi (16.5 MPa). Most preferably, the elastomeric material has initial tensile modulus equal to or less than about 1,200 psi (8.23 MPa).

Suitable flexible thermoplastic materials useful as the resin in this invention include, without limitation, one or more of the following: styrene-isoprene-styrene block copolymers, polybutadiene, polyisoprene, natural rubber, ethylene-propylene copolymers, ethylene-vinyl acetate copolymers, ethylene-acrylic acid copolymers, ethylene-propylene-diene terpolymers, polysulfide polymers, thermoplastic polyurethanes, polyurethane elastomers, chlorosulfonated polyethylene, polychloroprene, plasticized polyvinylchloride using dioctyl phthalate or other plasticizers well known in the art, butadiene acrylonitrile elastomers, poly (isobutylene-co-isoprene), polyacrylates, polyesters, polyethers, fluoroelastomers, silicone elastomers, thermoplastic elastomers, and copolymers of ethylene. Blends of two or more of the foregoing may also be employed.

One preferred group of elastomeric materials are block copolymers of conjugated dienes and vinyl aromatic copolymers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type R-$(BA)_x$ (x=3-150); wherein A is a block from a polyvinyl aromatic monomer and B is a block from a conjugated diene elastomer. A preferred resin matrix is a styrene-isoprene-styrene block copolymer, such as Kraton® D1107 styrene-isoprene-styrene block copolymer available from Kraton Polymer LLC. Another resin matrix useful herein is a thermoplastic polyurethane, such as a copolymer mix of polyurethane resins dispersed in water. Preferred resins include styrene-isoprene-styrene block copolymers, thermoplastic polyurethanes and blends thereof.

The resin used in the coating of the yarns preferably is a high elongation resin. For example, such coatings have elongations of at least about 200%, more preferably at least about 500% and most preferably at least about 1000%, as measured by ASTM 882.

The amount of resin coated on the yarns used in the invention may vary widely. Preferably, the resin coating comprises from about 2 to about 40 weight percent, more preferably from about 3 to about 25 weight percent, and most preferably from about 5 to about 15 weight percent, based on the total weight of the coated yarns after drying.

The resin may be coated on the yarns of the invention by any suitable coating apparatus. Examples of such coating apparatus include lube rolls, kiss rolls, dip baths spray coaters, etc. The resin may be in a solution, dispersion or an emulsion using any suitable solvent, such as water or an organic solvent (such as methyl ethyl ketone, acetone, ethanol, methanol, isopropyl alcohol, cyclohexane, ethyl acetone, etc. and combinations thereof). Preferably the yarns are dipped into a bath containing the coating composition. Following coating by any technique, excess coating composition may be squeezed out, blown off or drained off followed by air drying or drying in a heating device, or both.

Preferably, a plurality of yarns are coated at the same time. For example, fibers may be advanced from a creel to form a yarn used in the invention, with the fibers being extending in a substantially uniaxial direction and being substantially parallel to each other. A plurality of such yarns may be advanced into a coating bath or the like, with the yarns extending in a substantially uniaxial direction and being substantially parallel to each other.

The plurality of yarns is then advanced to a rope shaping apparatus in which the rope of the desired cross-section is obtained. The cross-section of the rope may be any desired cross-section, although circular or substantially circular cross-sections are preferred. It is also possible but less desirable to first arrange the yarns in the shape of the rope and then coat the yarns with the resin.

To shape the rope, any suitable shaping apparatus may be employed. For example, a circular die may be used as the shaping apparatus. The shaped rope has the desired cross-section and the resin coating on a yarn is in contact with the resin coating on an adjacent yarn. In this way, the rope can retain its shape. To enhance the adherence of adjacent coated yarns, the shaping apparatus is preferably heated or other energy may be applied during or after the shaping step. The shaped rope is then collected and wound up on a suitable apparatus, such as by wrapping onto a large drum. Besides circular, other cross-sectional shapes include, without limitation, hollow, square, rectangular or elliptical.

As mentioned previously, the coating of the yarns need not be continuous over the entire length of the yarns. Suitable means for providing discontinuous coatings are known in the art. For example, discontinuous coatings of fibers are disclosed in U.S. Pat. Nos. 5,061,545, 6,846,548 and 7,211,291, the disclosure of which are expressly incorporated herein by reference to the extent not incompatible herewith. Where discontinuous coatings are used, there is a sufficient amount of coating such that the rope is capable of retaining its desired shape.

For some applications, additional flexibility may be desired for the rope, especially to prevent damage due to small winding radii. Additional flexibility can be achieved by providing nodes along the length of the rope. Such nodes may be areas of compression of the rope that are formed uniformly or non-uniformly along the length of the rope. One manner of forming such nodes is to compress the rope every few inches or feet along its length, and this may be accomplished using shaping dies that intermittently compress the rope. This compression serves to move the resin coating away from the compressed areas. The result is a series of flexible hinges extending along the length of the rope.

If desired, the ropes may be provided with a protective jacket which may serve as a wear indicator. An indication of wearing of the outer jacket may be an indication that the main section of the rope is damaged or may be damaged by further use. One type of projective jacket is formed from yarns which may be of a different material than the high tenacity yarns that make up the rope. Alternatively, the jacket may be formed from the same type of yarns that form the rope. In addition, the ropes may be wrapped with woven fabric at about 90 degrees to the main direction of the rope in order to get the best coverage. The jacket may extend over all or a portion of the surface of the rope. Examples of yarns that may be used as the protective jacket include those formed from polyester fibers, nylon fibers, ultrahigh molecular weight polyethylene fibers, high density polyethylene fibers, polypropylene fibers, polytetrafluoroethylene fibers, other fluoropolymer fibers, etc., and blends of two or more of the foregoing. Protective jackets may also be formed by winding fibers around or braiding a series of fibers around the ropes of the invention. Ribbons made from the aforementioned polymers are also useful as protective jackets, whether they are wound, braided or woven. Another type of jacket useful herein is a tubing made from a suitable material (preferably polymeric) and in this case the ropes are inserted into the tubing. Similarly, the tubing could be cast, extruded, coated or otherwise provided around the rope. The protective jacket may be bonded or laminated to the outer surface of the rope, or it may be in loose contact with the outer surface of the rope.

It should be understood that relatively thick ropes may be formed from relatively thin ones by aligning several thinner ropes in parallel and covering them with a suitable jacket so as to retain the individual ropes in the shape of the desired larger rope. There is no need for a resin or other binder to adhere the individual ropes together within the jacket (although a binder may be present if desired). The type of jackets mentioned above for single ropes can be used for purposes of forming thicker ropes from a plurality of thinner ropes.

By this invention, high strength ropes can be formed even using standard high tenacity fiber of lower relative cost.

In a similar manner, ropes may be formed by passing the coated yarns through a heated die having dimensions similar to a tape. The ropes may be laminated with a thin film, wrapped with yarn or fabric, or contained within a braided or tubular cover.

Figure 2:
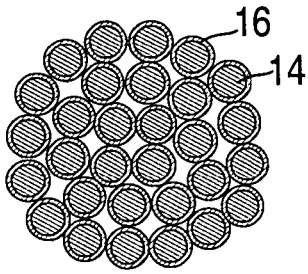
FIG. 2 is a cross-sectional view of the rope of FIG. 1, taken along line 2-2.
Figure 3:
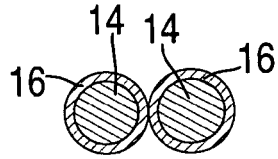
FIG. 3 is an expanded view of a portion of FIG. 2.

With reference to the drawings, where like numerals refer to like elements, and which are not necessarily to scale, there is shown in FIG. 1 a schematic of the rope 10 of this invention. FIG. 1 is a top view of a typical rope of the invention, which is formed from a plurality of high tenacity polyolefin yarns 14 that extend along the length "L" of the rope in a substantially uniaxial direction and are substantially untwisted. Yarns 14 are substantially parallel to each other and are connected to each other by resin coating 16 that coats the yarns. FIG. 2 is a cross-sectional view of a typical rope of the invention, and shows resin coatings 16 connecting the plurality of yarns such that adjacent yarns are connected together by contact of their respective coatings. FIG. 3 is an expanded schematic view of a portion of FIG. 2 showing yarns 14 and the contact of resin coatings 16 with each other.

Figure 4:
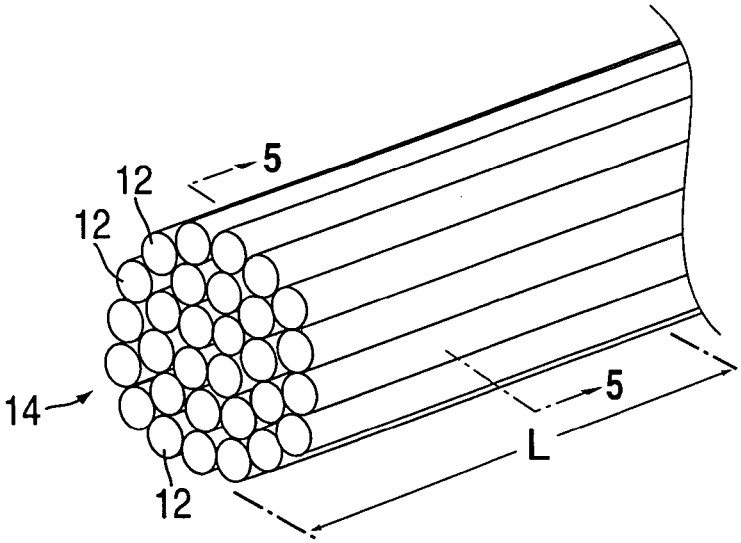
FIG. 4 is a schematic view of the yarns forming the rope of the invention.
Figure 5:
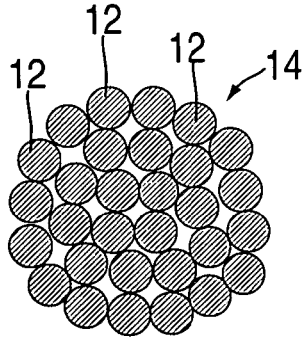
FIG. 5 is a cross-sectional view of the yarn of FIG. 4, taken along line 4-4.

As shown in FIG. 4, yarns 14 are formed from a plurality of high tenacity polyolefin fibers 12 that extend along length "$L_1$" of yarn 14 in a substantially uniaxial direction and are substantially untwisted. Fibers 12 are substantially parallel to each other. FIG. 5 is a cross-sectional view of a typical yarn 14 used in the rope of the invention, which yarn is formed from a plurality of fibers 12.

Figure 6:
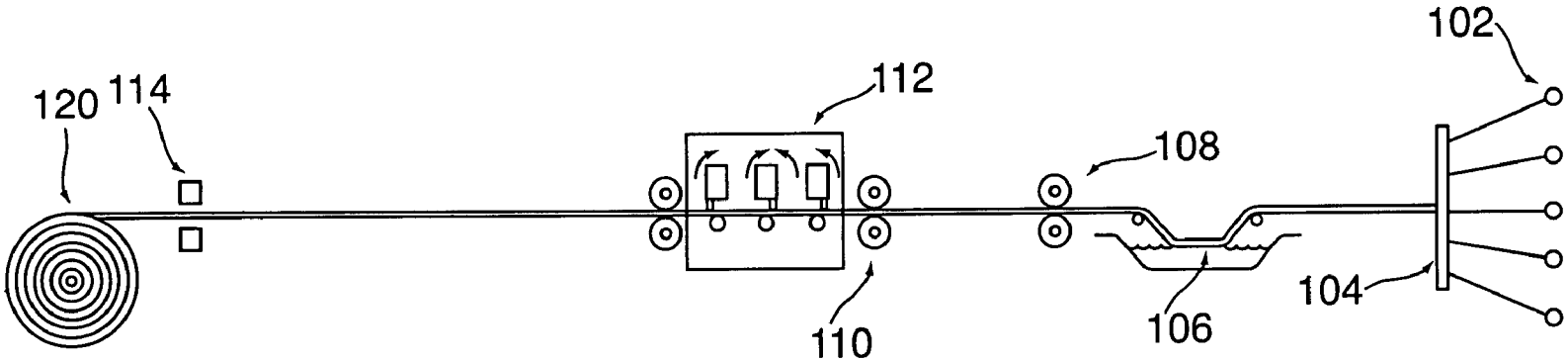
FIG. 6 is a schematic view of one method for forming the ropes of this invention.
Figure 7:
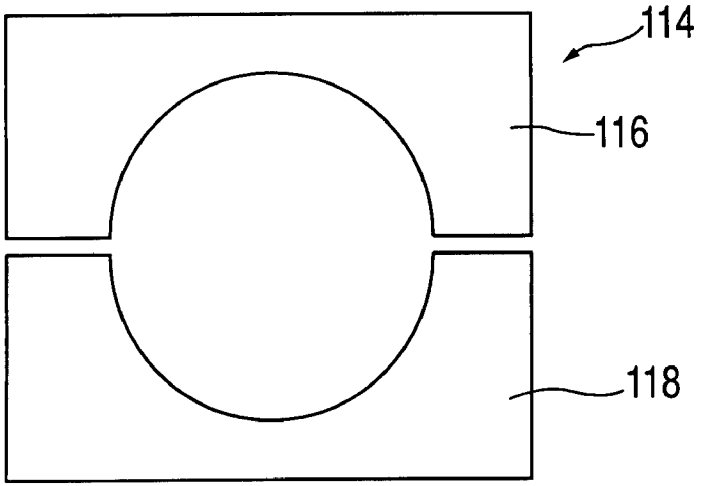
FIG. 7 is a schematic cross-sectional view of one type of shaping die useful in forming the ropes of the invention.

FIG. 6 depicts one method for forming the rope of this invention. A plurality of fibers 12 is supplied from a creel 102 and passed untwisted through a combing station 104 to align the fibers to be substantially parallel to each other and without twisting. It should be noted that there may be one combing station for each yarn. The uniaxially oriented untwisted yarns 14 are fed into a coating tank 106 where coating 16 is applied to the surfaces of yarns 14. The coated yarns are then passed through a pair of rollers 108 to squeeze out excess resin solution and preferably spread the resin coating substantially uniformly among and between the yarns. If desired, a pair of nip rollers 110 may be employed to control the thickness of the coated yarns. The coated yarns are then passed through a heated oven 112 for drying, wherein sufficient heat is employed to volatilize the coating solvent. The coated yarns are then passed through a shaping die 114 which may be of any desired configuration. A cross-sectional view of a typical shaping die 114 for a circular cross-section is shown in FIG. 7. Shaping die 114 is shown as having two semi-circular portions 116, 118 that are adapted to mate with each other and permit the rope to be shaped therein: The shaped rope is then wound on a roller or drum 120.

Figure 8:
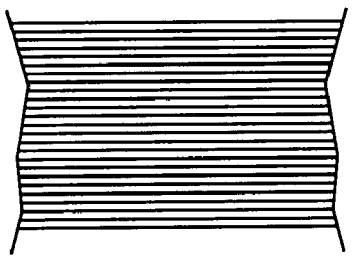
FIG. 8 is a schematic top view of the yarns prior to being shaped into the rope of the invention.

FIG. 8 is a schematic top view of the plurality of parallel yarns before they are shaped into a rope in the shaping die.

Figure 9:
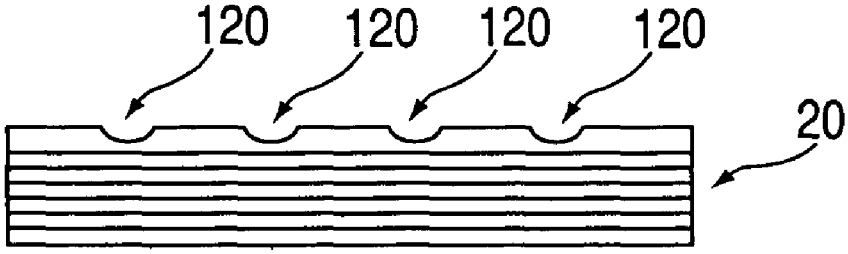
FIG. 9 is a schematic view of a rope of the invention having a plurality of nodes.

As pointed out above, a plurality of nodes may be provided on the surface of the rope to improve its flexibility. This is shown in FIG. 9, wherein rope 20 has several depressed areas 122 on the surface of the rope and which extend along length thereof. Areas 122 act as hinges for flexing of the rope.

Figure 10:
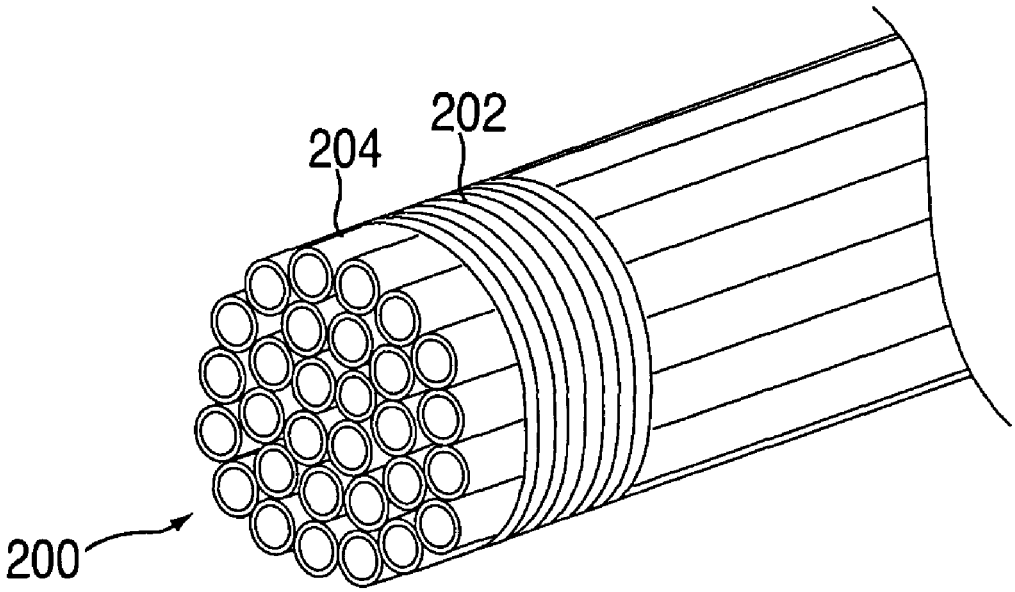
FIG. 10 is a schematic view of a rope of the invention having a fiber jacket.

FIG. 10 shows a rope 200 with one type of jacket 202. Jacket 202 is formed from a plurality of yarns 204 that are wrapped approximately 90 degrees to the major direction of rope 200. Jacket 202 may cover the entire portion of the surface of rope 200 or only intermittent portions along the length of the rope.

As mentioned above, the ropes of this invention can be used in many demanding applications, including marine applications, utility services, industrial, mooring and military applications. One such marine use is for heavy lifting and mooring of objects onto the seabed. Other marine applications include offshore oil and gas exploration, oceanographic, seismic and other industrial applications.

The following non-limiting examples are presented to provide a more complete understanding of the invention. The specific techniques, conditions, materials, proportions and reported data set forth to illustrate the principles of the invention are exemplary and should not be construed as limiting the scope of the invention.

EXAMPLES

Example 1

A uniaxially oriented rope was formed from extended chain polyethylene yarns. Each yarn was formed from SPECTRA® 900 fibers from Honeywell International Inc. The yarn had a denier of 2400 and there were 240 fibers in each yarn. The yarn had a tenacity of 25.5 g/d and a modulus of 270 g/d. The fibers were uniaxially oriented and parallel to each other, with no twist along their length. A total of 12 such yarns were arranged in a uniaxial direction and parallel to each other, with no twist in the yarns along their length. A substantially flat network of the yarns was passed into a coating bath of a styrene-isoprene-styrene block copolymer resin (Kraton® D1107) in an aqueous solvent at room temperature such that the resin coated substantially all of the surface of each yarn. Excess resin coating was removed from the yarns and the flat yarn assembly was passed through a hot air oven to remove the solvent. The amount of resin pick up on the yarns was 20% by weight. The yarns were then shaped into a circular rope having a diameter of about 3/16 (0.188) inch (4.76 mm) by a heated shaping die, again with no twisting. The rope was then collected on a large drum.

The resulting rope was tested for its breaking strength using test method CI-1500-02 (revised May 2006) from The Cordage Institute, entitled "Test Method for Fiber Rope", using the uncycled ropes method, and was found to have a breaking load of 2532 pounds (1150 kg).

Example 2 (Comparative)

A braided rope was formed from SPECTRA® 900 extended chain polyethylene fibers. The rope was formed from 12 yarn strands. Each strand was formed from 2 yarns that were twisted together. The yarns were first twisted into a cord at 10 turns per inch. Cords were twisted in the "S" direction and the "Z" direction". Twelve cords were loaded into a 12-strand braider in an alternating fashion (S, Z, S, Z, etc.). The braided rope had a diameter of about 0.188 inch (4.76 mm). The rope was tested for its breaking strength as in Example 1, and it was found that the rope had a breaking load of 933 pounds (424 kg).

Example 3 (Comparative)

Example 2 was repeated and it was found that the rope had a breaking load of 1015 pounds (461 kg).

By comparing the results of Example 1 with Examples 2 and 3' it can be seen that the unidirectional rope of the present invention had a breaking load that was more than twice that of a conventional braided rope of the same fiber material. As a result, the ropes of this invention can be used in more demanding applications than conventionally formed ropes of high tenacity polyolefins.

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A rope comprising a plurality of yarns aligned in a substantially uniaxial direction along the length of said rope, said yarns being substantially untwisted and being substantially parallel to each other, each of said yarns comprising a plurality of fibers aligned in a substantially uniaxial direction along the length of said yarns, said fibers being substantially untwisted and being substantially parallel to each other, said fibers comprising high tenacity polyolefin fibers, and a resin coated on the surface of said yarns wherein adjacent yarns are connected together by contact of their respective resin coatings, and wherein said resin comprises a flexible thermoplastic material, where in the rope has a breaking load of 2532 pounds.

2. The rope of claim 1 wherein said yarns have a denier of from about 100 to about 4800.

3. The rope of claim 1 wherein said yarns have a tenacity of at least about 20 g/d.

4. The rope of claim 1 wherein said yarns comprise high tenacity polyethylene fibers.

5. The rope of claim 1 wherein said fibers and said yarns have zero twist.

6. The rope of claim 1 wherein said rope has a substantially circular cross-section.

7. The rope of claim 1 wherein said resin comprises from about 2 to about 40 weight percent based on the total weight of said yarns and coating.

8. The rope of claim 1 wherein said resin comprises a high elongation resin.

9. The rope of claim 1 wherein said resin comprises a polyurethane resin.

10. The rope of claim 1 wherein said resin comprises a styrene-isoprene-sytrene block copolymer resin.

11. The rope of claim 1 wherein said rope has a diameter of from about 0.0625 inch (1.59 mm) to about 10 inches.

12. The rope of claim 1 wherein said rope has a diameter of from about 1.5 inches (38.1 mm) to about 5 inches (127 mm).

13. The rope of claim 1 wherein said resin is coated intermittently along the length of said yarns.

14. The rope of claim 1 wherein nodes are provided along the length of said rope to enhance the flexibility of said rope, said nodes comprising areas of reduced thickness.

15. The rope of claim 1 further comprising a jacket covering said rope.

16. The rope of claim 15 wherein said jacket is formed from fibers, and wherein said fibers of said jacket are wrapped about said yarns and extend substantially perpendicular to the direction of the length of said yarns.

17. The rope of claim 5 wherein said jacket is formed from a material that is different from the fibers in said yarns.

18. The rope of claim 1 wherein said rope consists essentially of high tenacity polyethylene yarns.

19. A rope consisting essentially of a plurality of yarns aligned in a substantially uniaxial direction along the length of said rope, said yarns being substantially untwisted and being substantially parallel to each other, each of said yarns consisting essentially of a plurality of fibers aligned in a substantially uniaxial direction along the length of the yarns, said fibers being substantially untwisted and being substantially parallel to each other, said fibers consisting essentially of high tenacity polyethylene fibers, and a resin coated on the surface of said yarns wherein adjacent yarns are connected together by contact of their respective resin coatings, and wherein said resin comprises a flexible thermoplastic material, where in the rope has a breaking load of 2532 pounds.

20. The rope of claim 1, wherein each yarn comprises from about 10 to about 3000 fibers.

21. The rope of claim 1, comprising from about 2 to about 50,000 yarns.

* * * * *